US007620335B2

(12) United States Patent
Inukai

(10) Patent No.: US 7,620,335 B2
(45) Date of Patent: Nov. 17, 2009

(54) IMAGE FORMING APPARATUS

(75) Inventor: Katsumi Inukai, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 218 days.

(21) Appl. No.: 11/637,708

(22) Filed: Dec. 13, 2006

(65) Prior Publication Data

US 2007/0147858 A1 Jun. 28, 2007

(30) Foreign Application Priority Data

Dec. 27, 2005 (JP) ..... 2005-375411

(51) Int. Cl.
*G03G 15/02* (2006.01)
*G03G 15/16* (2006.01)

(52) U.S. Cl. ..... 399/31; 399/170; 399/315

(58) Field of Classification Search ..... 399/31, 399/170, 315; 361/214, 221, 222, 213, 229, 361/225, 212, 235, 65
See application file for complete search history.

(56) References Cited

U.S. PATENT DOCUMENTS 3,843,906 A * 10/1974 Leibrecht ..... 361/235
4,669,862 A * 6/1987 Yagasaki et al.
6,754,058 B2 * 6/2004 Anzawa et al.
2005/0226644 A1 * 10/2005 Ino ..... 399/170

FOREIGN PATENT DOCUMENTS

JP 06348116 A * 12/1994
JP A 2000-112302 4/2000
JP 2002229397 A * 8/2002
JP A 2003-316128 11/2003
JP A 2003-330251 11/2003
JP A 2004-138838 5/2004
JP 2005322617 A * 11/2005

* cited by examiner

*Primary Examiner*—Susan S Lee
(74) *Attorney, Agent, or Firm*—Oliff & Berridge, PLC

(57) ABSTRACT

An image forming apparatus that includes: plural photosensitive members; plural charging units respectively opposed to the plurality of photosensitive members; a high-voltage power supply unit which applies a voltage to the charging unit; and a discharge detecting unit which detects discharge of the charging unit and detects abnormality of the charging unit, wherein the plural charging units are connected to the discharge detecting unit in parallel.

16 Claims, 8 Drawing Sheets

(FIG. 5 CONTINUED)
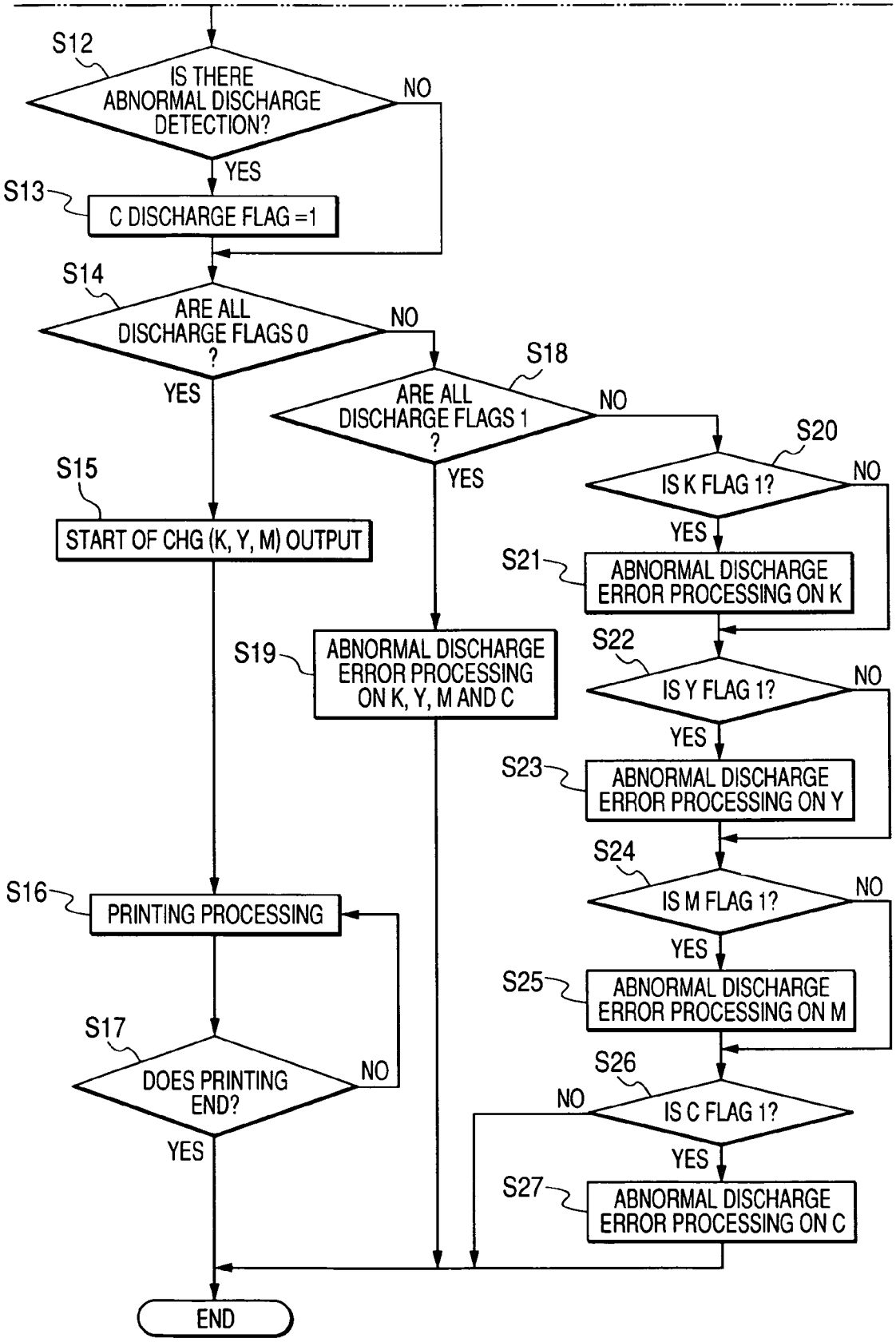

IMAGE FORMING APPARATUS

CROSS-REFERENCE TO RELATED APPLICATION

This application claims priority from Japanese Patent Application No. 2005-375411, filed Dec. 27, 2005, the entire subject matter of which is hereby incorporated by reference.

TECHNICAL FIELD

Aspects of the present invention relate to an image forming apparatus which detects occurrence of abnormality in a charging or static eliminating unit.

BACKGROUND

JP-A-2000-112302 and JP-A-2003-316128 disclose an image forming apparatus which detects abnormality produced in a charger.

The image forming apparatus disclosed in JP-A-2000-112302 1 includes one photosensitive member which is charged in the image forming time and transfers a toner image onto a paper sheet. In this image forming apparatus, a charge-side leak detection circuit is provided on an output side of a high-voltage power supply part connected to a primary charger, which charges the photosensitive member uniformly at a predetermined potential. The charge-side leak detection circuit detects occurrence of leak. Further, a static eliminator-side leak detecting circuit is provided on an output side of a high-voltage power supply part connected to a separation static eliminator, which eliminates transfer electric charge on the back surface of a paper sheet thereby to separate the paper sheet attached on the photosensitive member from the photosensitive member. The static eliminator-side leak detecting circuit detects occurrence of leak.

The image forming apparatus disclosed in JP-A-2003-316128 includes four high-voltage power supply parts and four chargers correspondingly to photosensitive drums of four colors. Each high-voltage power supply part is provided with a leak detection circuit which detects leak of charging bias.

SUMMARY

The leak detection circuit is provided for each charger to detect the abnormality in the image forming apparatus disclosed in JP-A-2000-112302 and JP-A-2003-316128. Therefore, the circuit configuration is complicated and expensive.

Aspects of the present invention provide an image forming apparatus in which circuit configuration is simple and low in cost.

DETAILED DESCRIPTION

Now, illustrative aspects of the invention will be described with reference to drawings.

(First Aspect)

An image forming apparatus according to a first aspect of the invention is a color electrophotographic printer 1. In the color electrophotographic printer 1 in the first aspect, one discharge detecting unit detects discharge states of plural chargers (charging units) 31 to detect abnormality.

<Configuration of Color Electrophotographic Printer>

Figure 1:
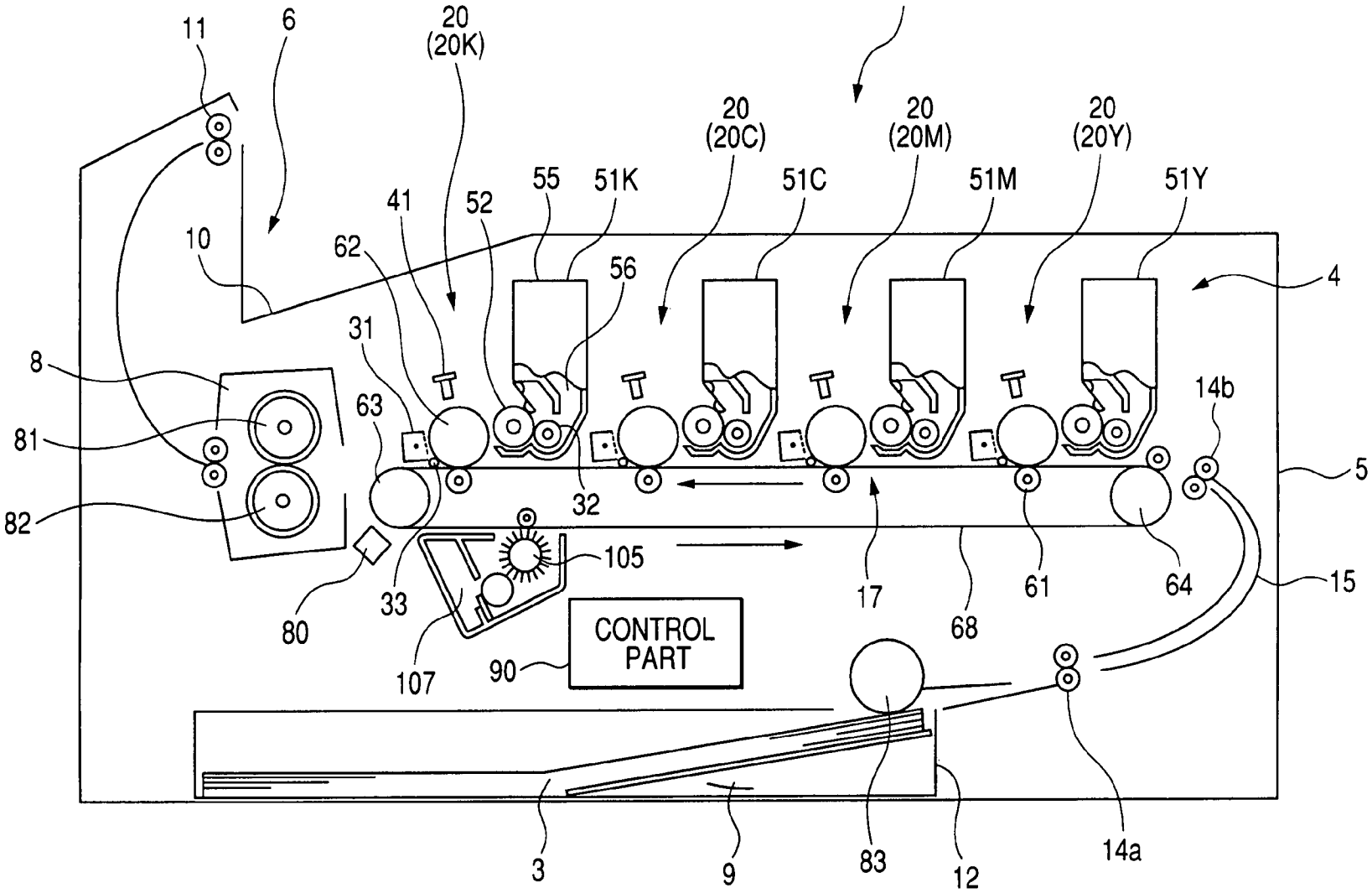
FIG. 1 is an explanatory view showing the schematic configuration of a color electrophotographic printer according to a first aspect of the invention.

FIG. 1 is a sectional view showing the schematic configuration of the color electrophotographic printer 1. In FIG. 1, the color electrophotographic printer 1 is a so-called transverse arrangement type tandem color electrophotographic printer in which four image forming units 20 are arranged in the horizontal direction. Herein, a body casing 5 includes a sheet supply part 9 for supplying a recording sheet 3 as a recorded medium, an image forming part 4 for forming an image on the supplied recording sheet 3, a sheet discharge part 6 for discharging the recording sheet 3 on which the image has been formed, and a control part 90 which controls an operation of the color electrophotographic printer 1.

The sheet supply part 9 includes, in the bottom portion in the body casing 5, a sheet supply tray 12 which is detachably attached to the body casing 5 from the front side (right side in FIG. 1), a feed roller 83 which is provided above one end (on the front side) of the sheet supply tray 12, and transporting rollers 14*a*, 14*b* which are provided on the downstream side in the transporting direction of the recording sheet 3 with respect to the feed roller 83 (hereinafter, the downstream side in the transporting direction of the recording sheet 3 may be abbreviated to a downstream side, and the upstream side in the transporting direction of the recording sheet 3 may be abbreviated to a upstream side.

In the sheet supply tray 12, the recording sheets 3 are stacked, and a top recording sheet of the stacked recording sheets 3 is supplied by rotation of the feed roller 83 toward the transporting rollers 14*a*, 14*b* one by one and sequentially transported between a transportation belt 68 and each photosensitive member 62 (transfer position).

Between the transporting roller 14*a* and the transporting roller 14*b*, a guide member 15 extending in the up-and-down direction is provided. The recording sheet 3 fed by the feed roller 83 is sequentially transported toward the transportation belt 68 and each photosensitive member 62 (the transfer position) by the transporting roller 14*a*, the guide member 15 and the transporting roller 14*b*.

The image forming part 4 includes, in an intermediate portion in the body casing 5, four image forming units 20Y, 20M, 20C and 20K which form respectively an image; a transfer part 17 which transfers an image formed in each image forming unit 20 onto the recording sheet 3; and a fixing part 8 which applies heat and pressure to the image transferred onto the recording sheet 3 thereby to fix the image to the recording sheet 3. The above appended characters Y, M, C, and K represent respectively each color of yellow (Y), magenta (M), cyan (C), and black (K). In case that it is not necessary to distinguish these colors from one another, the above appended characters are omitted.

Each image forming unit 20 has a photosensitive member 62 as an image bearing body 62. Each image forming unit 20, around the photosensitive member 62, has a static eliminator 33 which separates the recording sheet attached onto the photosensitive member 62 from the photosensitive member 62; a charger 31 which charges the photosensitive member 62; an exposure unit 41 which forms a electrostatic latent image on the photosensitive member 62; and a development unit 51 which attaches toner as developer onto the photosensitive member 62 by development bias applied between the photosensitive member 62 and the development unit 51 and forms a toner image.

The static eliminator 33 is connected to a later-described high-voltage power supply part 110, and so constructed as to generate AC corona discharge which is biased with the opposite polarity to polarity in transfer by a static eliminating wire such as a tungsten wire thereby to eliminate transfer bias on the back surface of the transfer sheet. The charger 31 is connected to the later-described high-voltage power supply part 110, and this charger 31 is a scorotron type charger for positive charge which generates corona discharge by a charging wire such as a tungsten wire thereby to charge the surface of the photosensitive member uniformly with positive polarity. The exposure unit 41 includes a LED array which generates light for forming an electrostatic latent image on the surface of the photosensitive member 62.

In this exposure unit 41, the light emitted from the LED array is applied onto the photosensitive member 62, and the electrostatic latent image is formed on the surface of the photosensitive member 62. The exposure unit 41 is not necessarily the LED array, and may be, for example, an exposure scan unit (laser scanner) which exposes the photosensitive member to light by scanning laser beam.

The development unit 51 includes, in a development casing 55, a hopper 56, a supply roller 32 and a development roller 52. The hopper 56 is formed as inner space of the development casing 55. In this hopper 56, toner (for example, non-magnetic mono-component polymerized toner of positive chargeability) of each color of yellow (Y), magenta (M), cyan (C), and black (K) is housed in each image forming unit 20.

Namely, the above four image forming units 20 are composed of the image forming unit 20Y in which the yellow (Y) toner is housed in the hopper 56, the image forming unit 20M in which the magenta (M) toner is housed in the hopper 56, the image forming unit 20C in which the cyan (C) toner is housed in the hopper 56, and the image forming unit 20K in which the black (K) toner is housed in the hopper 56. These image forming units are different in only color of toner but have the similar configuration (In FIG. 1, a part of reference characters is omitted).

The supply roller 32 is arranged on the lower side of the hopper 56 and formed by covering a metallic roller shaft with a roller portion formed of a conductive sponge member. This supply roller 32 is rotatably supported, at a nip portion where the supply roller 32 comes into contact with the development roller 52, so as to rotate in the opposite direction to the rotational direction of the development roller 52.

The development roller 52 is rotatably arranged sideways of the supply roller 32 in a position where it comes into contact with the supply roller 32. The development roller 52 is formed by covering a metallic roller shaft with a roller portion formed of an elastic member such as conductive rubber material. A predetermined development bias voltage is applied from a power supply 85 (refer to FIG. 2) to the development roller 32 as described later.

The transfer part 17 is provided in the body casing 5 so as to be opposed to the photosensitive member 62. This transfer part 17 includes a transportation belt drive roller 63, a transportation belt driven roller 64, a transportation belt 68 that is an endless belt, and a transfer roller 61.

The transportation belt driven roller 64 is arranged on the more upstream side (more forward side) than the photosensitive member 62 of the yellow image forming unit 20Y which is located on the most upstream side in the transporting direction of the recording sheet 3. The driven roller 64 is more forward side than the feed roller 83. Further, the transportation belt drive roller 63 is arranged on the more downstream side (backer side) than the photosensitive member 62 of the black image forming unit 20K which is located on the most downstream side in the transporting direction of the recording sheet 3. The drive roller 63 is arranged on the more upstream side (more forward side) than the fixing part 8.

The transportation belt 68 is wound around the transportation belt drive roller 63 and the transportation belt driven roller 64. The transportation belt 68 is arranged so that its outer surface laid between the rollers comes into contact with all photosensitive members 62 of the respective image forming units 20.

By drive of the transportation belt drive roller 63, the transportation belt driven roller 64 is driven, and the transportation belt 68 moves around the transportation belt drive roller 63 and the transportation belt driven roller 64 counterclockwise. Namely, the transportation belt 68 moves, in the contact surface which comes into contact with each photosensitive member 62 of each image forming unit 20, in the same direction as the direction of the photosensitive member 62.

Further, the transfer rollers 61 are arranged respectively so as to be opposed, inside the transportation belt 68 wound around the rollers 63 and 64, to the photosensitive member 62 of each image forming unit 20 with the transportation belt 68 interposed therebetween. This transfer roller 61 is formed by covering a metallic roller shaft with a roller portion formed of an elastic member such as conductive rubber material.

The transfer roller 61 is provided rotatably counterclockwise so as to rotate in the same direction as the moving-around direction of the transportation belt 68 at a contact surface with the transportation belt 68. Between this transfer roller 61 and the photosensitive member 62, a predetermined voltage is applied at the transfer time from a not-shown power supply in the direction where the toner image born on the photosensitive member 62 is shifted (transferred) to the recording sheet 3, and appropriate transfer bias is applied by constant-current control.

The fixing part 8 is arranged on the downstream side (rear side) of the image forming unit 20 and the transfer part 17. This fixing part 8 includes a heat roller 81 and a pressure roller 82. The heat roller 81 has a metallic pipe on a surface of which a release layer is formed. The heat roller 81 includes a halogen lamp extending in its axial direction. The surface of the heat roller 81 is heated by the halogen lamp at a fixing temperature. Further, the pressure roller 82 is arranged so as to press the heat roller 81.

The sheet discharge part 6 is arranged, at the upper portion of the body casing 5, on the downstream side of the fixing part 8. The sheet discharge part 6 includes a pair of discharge rollers 11 which discharges the recording sheet 3, on which image fixing is completed, to the discharge tray 10; and the exit tray 10 which is arranged on the downstream side of the discharge rollers 11 and stacks thereon the recording sheet 3 which has completed all image forming steps.

Further, diagonally to the lower rearside of the transportation belt drive roller 63, a density sensor 80 for reading a patch formed on the transportation belt 68 is provided opposed to the outer surface of the transportation belt 68. Diagonally to the lower front of the transportation belt drive roller 63, a toner collector 107 for collecting toner such as the patch attached on the transportation belt 68 is arranged so that a toner collecting roller 105 of the toner collector 107 comes into contact with the outer surface of the transportation belt 68.

<Electric Configuration of Color Electrophotographic Printer>

Figure 2:
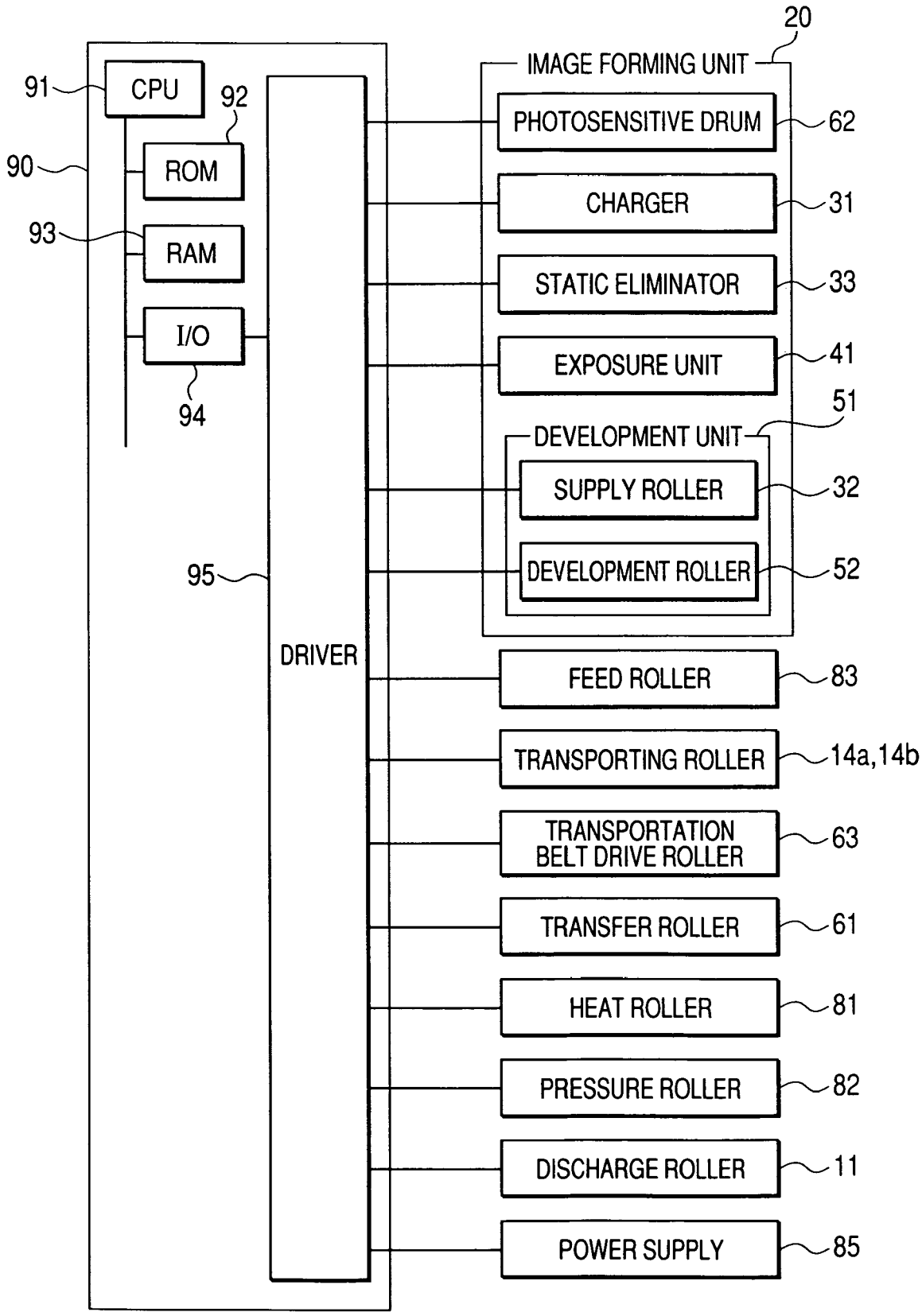
FIG. 2 is a block diagram showing schematically the electric configuration of the color electrophotographic printer shown in FIG. 1.

Next, referring to FIG. 2, together with the electric configuration of the color electrophotographic printer 1, a process till the color electrophotographic printer 1 forms a color image on the recording sheet 3 will be described. FIG. 2 is a block diagram showing schematically the electric configuration of the color electrophotographic printer 1.

As shown in FIG. 2, the color electrophotographic printer 1 includes a control part 90 (including a CPU 91, a ROM 92, a RAM 93, an I/O 94, a driver 95, and the like) which exercise general control of each component in the apparatus. The control part 90 detects abnormal discharge of the charger 31, and specifically arc discharge to detect abnormality of the charger 31.

To the control part 90, there are connected the photosensitive member 62 the charger 31, the static eliminator 33, the exposure unit 41, and the supply roller 32 and development roller 52 of the development unit 51, which are provided for the image forming unit 20. Further, to the control part 90, there are connected the feed roller 83, the transportation rollers 14*a*, 14*b*, the transportation roller drive roller 63, the transfer roller 61, the heat roller 81, the pressure roller 82, the discharge roller 11, and the power supply 85.

When the power supply 85 is switched on, a main control processing section (program) starts and the control part 90 in the color electrophotographic printer 1 enters a standby state. The control part 90, upon input of an image forming command, performs initial setting of each apparatus component to be controlled by the main control processing section (program). Thereafter, the control part 90 charges uniformly the surface of the photosensitive member 62 by the charger 31, and applies light from the exposure unit 41 to the photosensitive member 62 in accordance with image information, thereby to form an electrostatic latent image on the surface of the photosensitive member 62. Next, on the surface of this photosensitive member 62, toner is attached by the development unit 51, whereby the electrostatic latent image on the surface of the photosensitive member 62 is developed. Next, with rotation of the photosensitive member 62, the developed toner image is moved to the transfer position.

Further, the control part 90 actuates the feed roller 83 and the transporting rollers 14*a*, 14*b*, thereby to supply the recording sheet 3 to the transportation belt 68. Next, the control part 90 drives the transportation belt drive roller 63, moves the transportation belt 68 around, and supplies the recording sheet 3 to the transfer position. In the transfer position, the transfer bias is applied between the transfer roller 61 and the photosensitive member 62, whereby the toner image is transferred onto the recording sheet 3.

Next, the control part 90 circularly moves the transportation belt 68 and transports the recording sheet 3 to the fixing part 8. At this time, since the control part 90 eliminates the transfer bias from the recording sheet 3 by the static eliminator 33, the recording sheet 3 can be readily separated from the photosensitive member 62 and transported to the fixing part 8 smoothly. In the fixing part 8, the recording sheet 3 is transported while being held between the heat roller 81 and the pressure roller 82, and heat and pressure are applied onto the toner image on the recording sheet 3 to fix the toner image on the recording sheet 3. Next, the control part 90 actuates the discharge rollers 11, whereby the recording sheet 3 is discharged on the discharge tray 10 located at the upper portion of the body casing 5, and the image forming operation ends.

<Discharge Detection Circuit>

Figure 3:
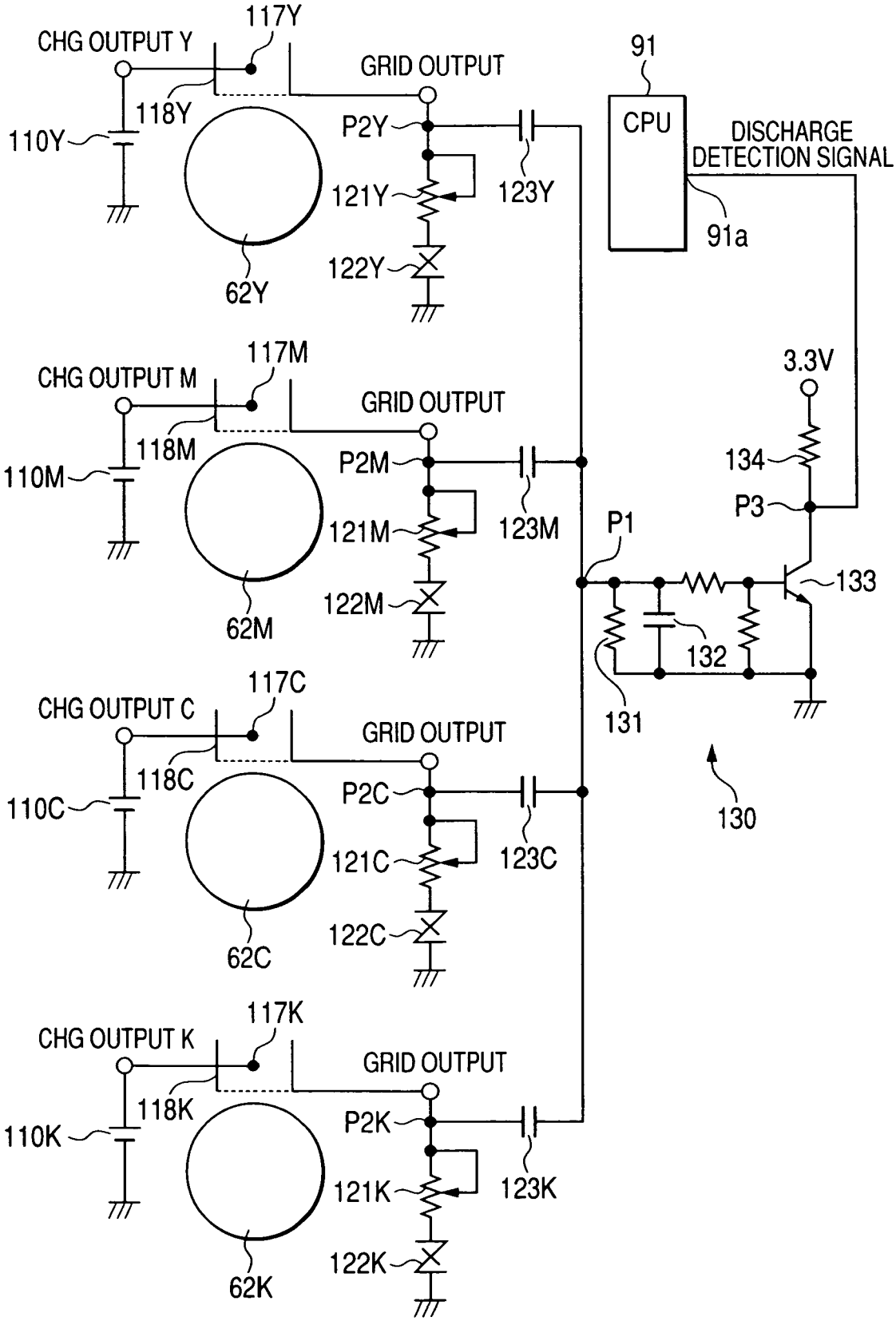
FIG. 3 is a diagram showing a discharge detection circuit used in the color electrophotographic printer shown in FIG. 1.

FIG. 3 is a diagram showing a discharge detection circuit 130 used by the color electrophotographic printer 1 shown in FIG. 1. To the discharge detection circuit 130 as a "discharge detecting unit", a first charger 117Y as a "first charging or static eliminating unit", a second charger 117M as a "second charging or static eliminating unit", a third charger 117C as a "third charging or static eliminating unit", and a fourth charger 117K as a "fourth charging or static eliminating unit" are connected in parallel. The discharge detection circuit 130 detects arc discharge which is partially produced when the first to fourth chargers 117Y, 117M, 117C and 117K charge respectively the first to fourth photosensitive members 62Y, 62M, 62C and 62K, thereby to detect abnormalities in the first to fourth chargers 117Y, 117M, 117C and 117K. A discharge detection program as a "high-voltage power supply control unit" detects the arc discharge of the charger 117 by means of the discharge detection circuit 130 thereby to specify the charger 117 in which the abnormality is produced. The discharge detection program is stored in the CPU 91. The discharge detection program will be described later.

The charger 117 is provided for the photosensitive member 62 one-to-one and applies a high charge voltage generated by the high-voltage power supply part 110 to the photosensitive member 62 thereby to charge the photosensitive member 62. The configuration of the high-voltage power supply part 110 will be described later. The electric current supplied to the charger 117 is corona-discharged between the charger 117, and a GRID part 118 and the photosensitive member 62, whereby the photosensitive member 62 is charged. Therefore, electric potential of the photosensitive member 62 is determined by the GRID part 118.

The GRID part 118 outputs the electric current toward a connection point P2 by the voltage produced in the discharge time. To the connection point P2, a constant voltage circuit in which a variable resistor 121 and a varistor 122 are connected in series, and a condenser 123 are connected in parallel. The constant voltage circuit adjusts the voltage of the connection point P2 so that GRID voltage becomes a predetermined voltage. The voltage of the connection point P2 can be changed by adjusting a resistant value of the variable resistor 121. In this aspect, the resistant value of the variable resistor 121 is adjusted so that the voltage of the connection point P2 comes to 900 volts. The condenser 123 lets the sharply increasing electric current which is produced when the arc discharge is generated between a charging wire constituting the charger 117 and the GRID part 118 flow from the connection point P2 through a connection point P1 to the discharge detection circuit 130. As the condenser 123 in this aspect, there is used what lets the electric current flow when the voltage of 900V or more is applied.

The discharge detection circuit 130 includes a resistor 131, a condenser 132, a transistor 133, and a resistor 134. The resistor 131 and the condenser 132 are provided in order to adjust the voltage applied to the connection point P1. Namely, the resistor 131 adjusts the voltage applied to the connection point P1, and the condenser 132 decreases a peak value of the voltage applied to the connection point P1, whereby an output signal to be outputted to the transistor 133 is taken out. Thus, even in case that the electric current supplied to the connection point P1 includes noise, since the transistor 133 reacts with only the output signal which applies the large voltage which is the predetermined voltage or higher to the connection point P1, the discharge detection circuit 130 can eliminate the influence of the noise on discharge detection.

In the transistor 133, an emitter is connected to the ground, a collector is connected through a connection point P3 and a resistor 134 to a power supply, and a base is connected to the connection point P1. The connection point P3 is provided between the collector of the transistor 133 and the power source, and connected to an input port 91*a* provided on the CPU 91.

The resistor 134 is provided in order to pull-up the voltage of the connection point P3.

The input port 91*a* of the CPU 91 performs the discharge detection on the basis of the voltage of the connection point P3. The CPU 91 determines, when the electric current does not flow between the collector and the emitter of the transistor 133, and the voltage of the connection P3 is made about 3.3V, that the input port 91*a* is put in a high state (hereinafter referred to as an "H") and normal discharge, that is, corona discharge is performed. On the other hand, when the electric current flows between the collector and the emitter of the transistor 133, and the voltage of the connection P3 becomes low and 0V or enters in a state close to 0V, the CPU 91 determines that the input port 91*a* is put in a low state (hereinafter referred to as an "L") and abnormal discharge, that is, arc discharge is partially generated in the charging wire which constitutes the charger 117.

<High-Voltage Power Supply Part>

Figure 4:
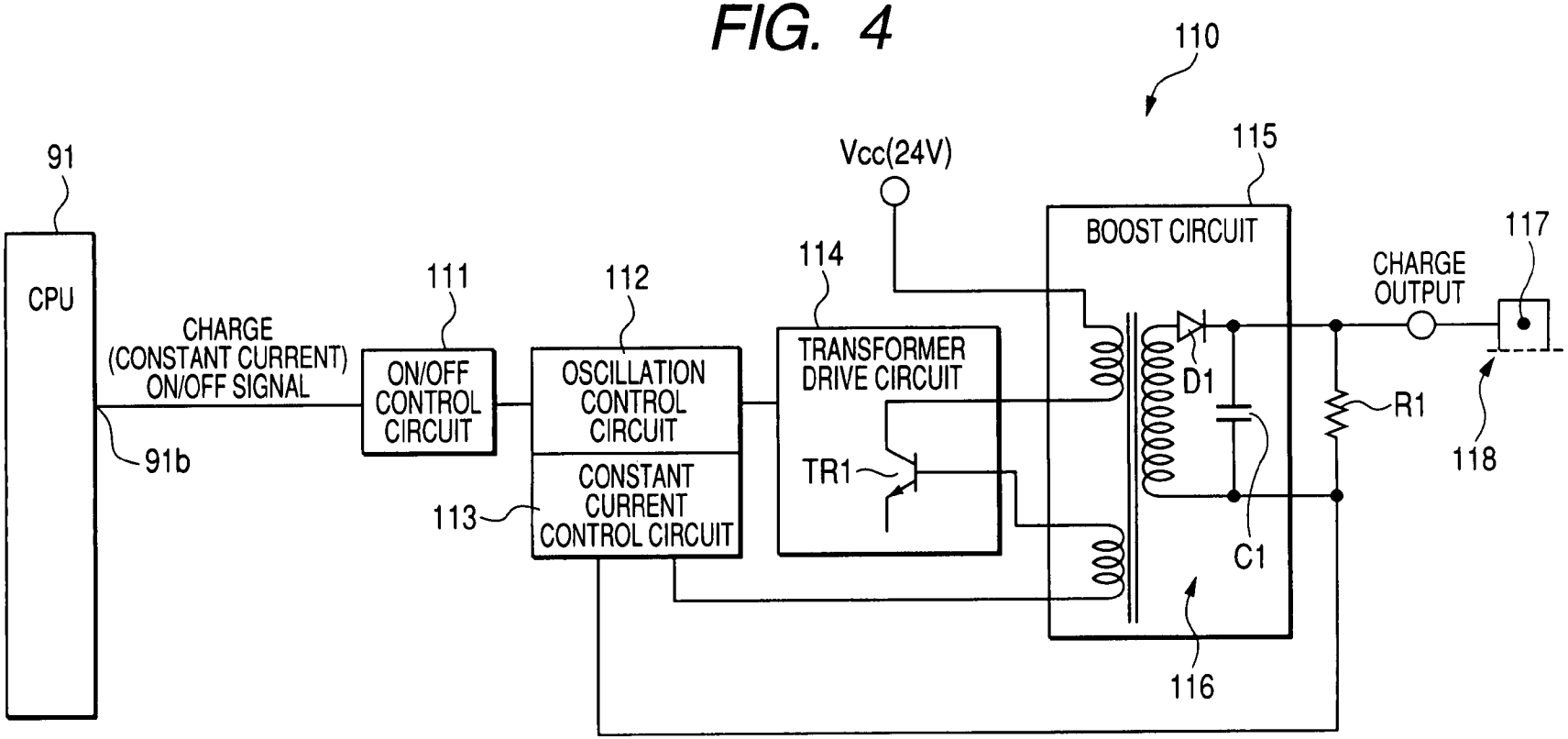
FIG. 4 is a block diagram of a high-voltage power supply part shown in FIG. 3.

FIG. 4 is a block diagram of the high-voltage power supply part 110 shown in FIG. 3.

One high-voltage power supply part 110 is provided for each charger 117, and its operation of applying the high voltage to the charger 117 is controlled by the CPU 91. The high-voltage power supply part 110 includes an ON/OFF control circuit 111, an oscillation control circuit 112, a constant-current control circuit 113, a transformer drive circuit 114, a boost circuit 115, and a smoothing commutation circuit 116.

The ON/OFF control circuit 111, which is connected to an output port 91*b* of the CPU 91, controls the ON/OFF state of the high-voltage power supply port 110 in accordance with an output signal (constant current) outputted from the output port 91*b*.

The oscillation control circuit 112 starts oscillation of a transformer. In this aspect, the oscillation control circuit 112 outputs an ON/OFF signal to the transformer drive circuit 114 at a frequency of 40 to 50 KHz.

The transformer drive circuit 114 switches a transistor TR1 between the conductive state and the non-conductive state according to the ON/OFF signal inputted from the oscillation control circuit 112, thereby to control applying timing in which the high-voltage power supply part 110 applies the high voltage to the charger 117. In the transistor TR1, an emitter is connected to the ground, a collector is connected through the boost circuit 115 to an output power supply in which the voltage is 24V, and a base is connected to the constant-current control circuit 113. In this aspect, the transformer drive circuit 114 generates a pulse signal of 24V and supplies the pulse signal to a winding portion of the boost circuit 115.

The boost circuit 115 generates the voltage according to a winding ratio of the winding portion. In this aspect, the boost circuit 115 increases the voltage outputted from the output power supply from 24V to 6000V. In the boost circuit 115, the smoothing commutation circuit 116 composed of a diode D1 and a condenser C1 is included. The smoothing commutation circuit 116 commutates the pulse signal outputted from the winding portion to a Sin-wave in the diode D1, and makes the commutated signal a smooth direct current in the condenser C1.

Between the boost circuit 115 and the charger 117, a bleeder resistance R1 is provided, which releases the electric charge remaining in the condenser C1 through the bleeder resistance R1 when the transformer drive circuit 114 enters the OFF state and the boost circuit 115 comes not to supply the electric current to the charger 117.

The constant-current control circuit 113 supplies the electric current which is caused to flow from the high-voltage power supply part 110 to the ground and thereafter returned, to the base of the transistor TR1 in the transformer drive circuit 114. The constant-current control circuit 113, by the current value of the base current of the transistor TR1, changes the high-voltage pulse width (duty ratio) which the boost circuit 115 applies to the charger 117, and can feedback-control the high voltage.

In such the high-voltage power supply part 110, when the power supply 85 (refer to FIG. 2) of the color electrophotographic printer 1 is switched on, the ON/OFF control circuit 111 is switched from the OFF state to the ON state, and the constant current is supplied to the oscillation control circuit 112. The oscillation control circuit 112 outputs the ON/OFF signal to the transformer drive circuit 114. The transformer drive circuit 114 pulse-outputs the electric current from the output power supply to the boost circuit 115 according to the ON/OFF signal from the oscillation control circuit 112. The boost circuit 115 increases the voltage applied from the output power supply to about 6000V, and applies its increased voltage to the charger 117.

The voltage applied to the charger 117 supplies the electric current to the GRID part and the photosensitive member 62, is returned to the constant current control circuit 113, and used for feedback control. Further, the voltage applied to the charger 117 is corona-discharged between the charging wire of the charger 117, and the GRID part 118 and the photosensitive member 62, thereby to charge the photosensitive member 62. According to such the high-voltage power supply part 110, while the power supply 85 of the color electrophotographic printer 1 is switched on, the high voltage of about 6000 volts can be stably applied to the charger 117 at the constant current.

<Discharge Detection Program>

Figure 5:
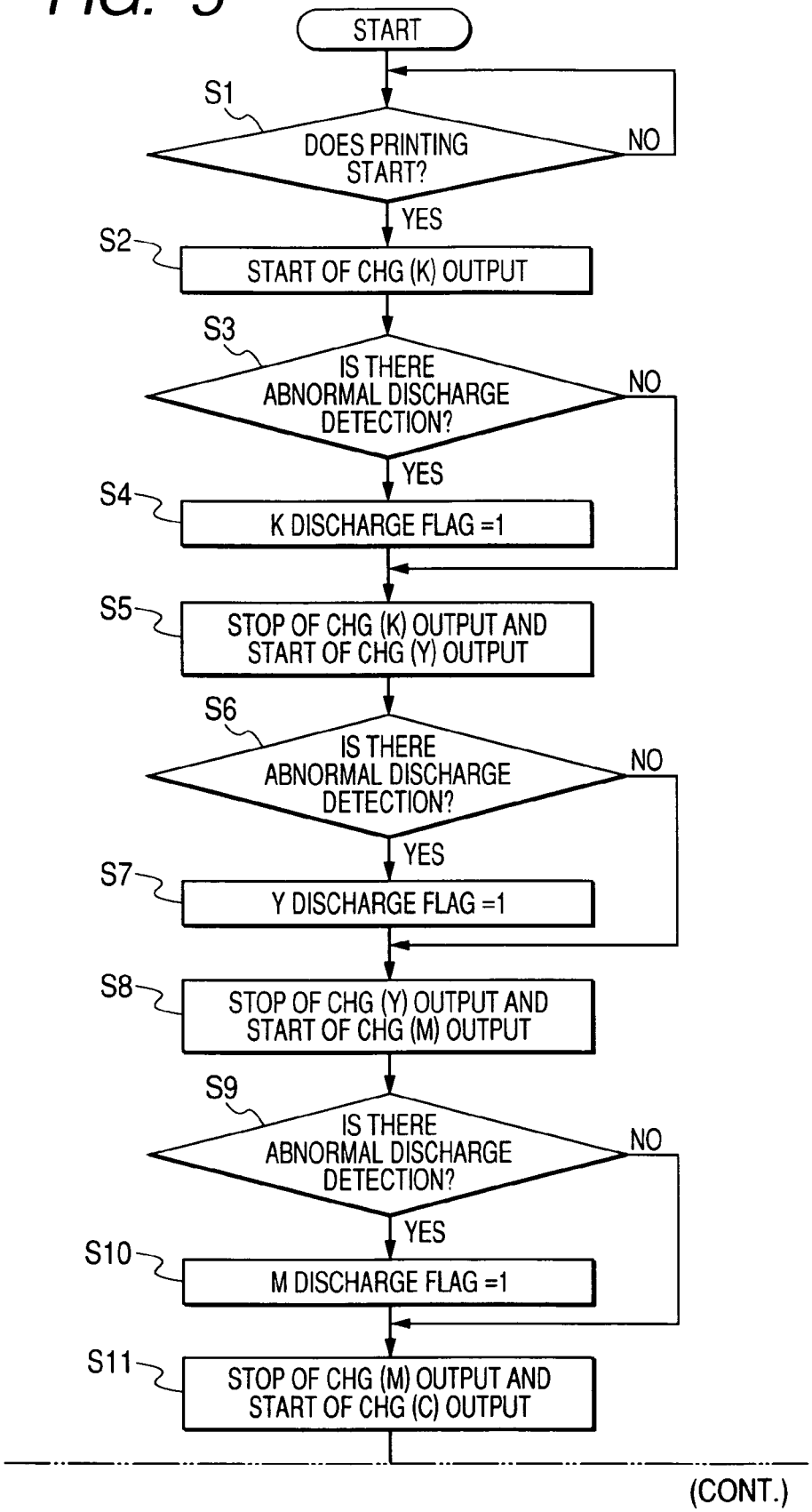
FIG. 5 is a diagram showing a processing procedure of a discharge detection program executed by CPU shown in FIG. 3.

FIG. 5 is a diagram showing a processing procedure of a discharge detection program.

The discharge detection program shown in FIG. 5 is saved in the ROM 92 of the control part 90 shown in FIG. 2, and executed by the CPU 91. The discharge detection program detects the discharge states of the first to fourth chargers 117Y, 117M, 117C and 117K by the single discharge detection circuit 130, and specifies the charger 117Y, 117M, 117C, or 117K in which the abnormal discharge such as the arc discharge is produced.

The discharge detection program, firstly in a step 1 (hereinafter described shortly as "S1"), determines whether or not the color electrophotographic printer 1 has started printing. In case that the color electrophotographic printer 1 has not started printing (S1: NO), the program stands by as it is. On the other hand, in case that the color electrophotographic printer 1 has started printing (S1: YES), the program causes the fourth high-voltage power supply part 110K to output a charge voltage to the fourth charger 117K in S2. Thereafter, the program determines in S3 whether or not the abnormal discharge (arc discharge) of the fourth charger 117K has been detected. In case that the abnormal discharge (arc discharge) has not been detected (S3: NO), the program proceeds to S5 directly. On the other hand, in case that the abnormal discharge (arc discharge) has been detected (S3: YES), the program raises a K discharge flag for black (K) of "1", and thereafter proceeds to S5.

In S5, the program stops the output of the charge voltage from the fourth high-voltage power supply part 110K to the fourth charger 117K, and causes the first high-voltage power supply part 110Y to output a charge voltage to the first charger 117Y. Next, the program determines in S6 whether or not the abnormal discharge (arc discharge) of the first charger 117Y has been detected. In case that the abnormal discharge (arc discharge) has not been detected (S6: NO), the program proceeds to S8 directly. On the other hand, in case that the abnormal discharge (arc discharge) has been detected (S6: YES), the program raises a Y discharge flag for yellow (Y) of "1" in S7, and thereafter proceeds to S8.

In S8, the program stops the output of the charge voltage from the first high-voltage power supply part 110Y to the first charger 117Y, and causes the second high-voltage power supply part 110M to output a charge voltage to the second charger 117M. Next, the program determines in S9 whether or not the abnormal discharge (arc discharge) of the second charger 117M been has detected. In case that the abnormal discharge (arc discharge) has not been detected (S9: NO), the program proceeds to S11 directly. On the other hand, in case that the abnormal discharge (arc discharge) has been detected (S9: YES), the program raises an M discharge flag for magenta (M) of "1" in S10, and thereafter proceeds to S11.

In S11, the program stops the output of the charge voltage from the second high-voltage power supply part 10M to the second charger 117M, and causes the third high-voltage power supply part 110C to output a charge voltage to the third charger 117C. Next, the program determines in S12 whether or not the abnormal discharge (arc discharge) of the third charger 117C has been detected. In case that the abnormal discharge (arc discharge) has not been detected (S12: NO), the program proceeds to S14 directly. On the other hand, in case that the abnormal discharge (arc discharge) has been detected (S12: YES), the program raises a C discharge flag for cyan (C) of "1" in S13, and thereafter proceeds to S14.

In S14, the program determines whether or not all the discharge flags for yellow (Y), magenta (M), cyan (C), and black (K) indicate "0". In case that the program determines that all the discharge flags indicate "0" (S14: YES), the program starts the output of the charge voltage to the first, second and fourth chargers 117Y, 117M and 117K in S15, and performs printing processing in S16. Thereafter, in S17, the program determines whether or not the printing processing has ended. In case that the program determines that printing processing has not ended (S17: NO), the program returns to S16 and continues the printing processing. On the other hand, in case that the program determines that printing processing has ended (S17: YES), the programs completes the discharge detection processing in the printing processing.

To the contrary, in case that the program determines that all the discharge flags do not indicate "0" (S14: NO), the program determines in S18 whether or not all the discharge flags indicate "1". In case that the program determines that all the discharge flags indicate "1" (S18: YES), the program performs abnormal discharge error processing on the first to fourth chargers 17Y, 117M, 117C and 117K in S19.

On the other hand, in case that the program determines that all the discharge flags do not indicate "1" (S18: NO), the program determines in S20 whether or not the K discharge flag indicates "1". In case that the program determines that the K discharge flag does not indicate "1" (S20: NO), the program proceeds to S22 directly. In case that the program determines that the K discharge flag indicates "1" (S20: YES), the program performs the abnormal discharge error processing on the fourth charger 117K in S21, and thereafter proceeds to S22.

Next, the program determines in S22 whether or not the Y discharge flag indicates "1". In case that the program determines that the Y discharge flag does not indicate "1" (S22: NO), the program proceeds to S24 directly. In case that the program determines that the Y discharge flag indicates "1" (S22: YES), the program performs the abnormal discharge error processing on the first charger 117Y in S23, and thereafter proceeds to S24.

Next, the program determines in S24 whether or not the M discharge flag indicates "1". In case that the program determines that the M discharge flag does not indicate "1" (S24: NO), the program proceeds to S26 directly. In case that the program determines that the M discharge flag indicates "1" (S24: YES), the program performs the abnormal discharge error processing on the second charger 117M in S25, and thereafter proceeds to S26.

Next, the program determines in S26 whether or not the C discharge flag indicates "1". In case that the program determines that the C discharge flag does not indicate "1" (S26: NO), the program completes the processing directly. In case that the program determines that the C discharge flag indicates "1" (S26: YES), the program performs the abnormal discharge error processing on the third charger 117C in S27, and thereafter completes the processing.

<Operation of Color Electrophotographic Printer>

The operation of the color electrophotographic printer 1 having the above configuration will be described.

The color electrophotographic printer 1, when the power supply 85 shown in FIG. 2 is switched on, puts the ON/OFF control circuit 111 of the high-voltage power supply part 110 in the ON state and supplies the constant current from the CPU 91 to the high-voltage power supply part 110. Further, the color electrophotographic printer 1 activates the discharge detection program shown in FIG. 5, and starts the detection of the abnormal discharge (arc discharge).

<In Case that there is No Abnormality in Charger>

Firstly, a case in which only the corona discharge is produced in the first to fourth chargers 117Y, 117M, 117C and 117K, and the abnormal arc discharge is not produced will be described.

The color electrophotographic printer 1, upon reception of a print starting command from an external device such as a personal computer, makes different the applying timings in which the first to fourth high-voltage power supply parts 110Y, 110M, 110C and 110K apply the high voltage to the first to fourth chargers 117Y, 117M, 117C and 117K, and detects the discharge states of the chargers.

Specifically, the control part 90 drives the oscillation control circuit 112K of the fourth high-voltage power supply part 110K, generates the high-voltage of about 6000V from the boost circuit 115K, and charge-outputs its high voltage from the fourth high-voltage power supply part 110K to the fourth charger 117K. The electric current supplied to the fourth charger 117 is corona-discharged between the fourth charger 117K, and the fourth GRID part 118K and the fourth photosensitive member 62K, whereby the photosensitive member 62*k* is charged. The fourth GRID part 118K supplies the electric current to the connection point P2K by the electric current in the corona discharge time. Its electric current, at the connection point P2K, generates the voltage from the constant-voltage circuit composed of the variable resistor 121K and the varistor 122K.

While the color electrophotographic printer 1 repeats printing, the black (K) toner or paper powder adheres to the charging wire constituting the fourth charger 117K and accumulates thereon. The voltage in the discharge time becomes higher as the thickness of the accumulations accumulating on the charging wire of the fourth charger 117K becomes larger. However, in case that the toner or the paper powder accumulates around the charging wire of the fourth charger 117K with the nearly uniform thickness, the fourth charger 117K generates the corona discharge on the fourth photosensitive member 62K and charges the surface of the fourth photosensitive member 62K uniformly with positive polarity. In this case, the voltage in the discharge time does not become too high momentarily, so that the large electric current does not flow to the condenser 123K. Therefore, the electric current supplied to the connection point P2 is stored in the condenser 123K and not be supplied to the discharge detection circuit 130.

As a result, in the discharge detection circuit 130, the base current of the transistor 133 does not flow, and a discharge detection signal "H" is outputted to the input port 91*a* of the CPU 91. Then, the CPU 91 determines that the fourth charger 117K is discharging normally, that is, the fourth charger 117K is not generating the arc discharge, and keeps the K discharge flag "0" as it is, without raising the K discharge flag "1" (refer to FIG. 3, and S2 and S3: NO in FIG. 5).

Thereafter, the CPU 91 stops the charge-output from the fourth high-voltage power supply part 110K to the fourth charger 117K, and performs the charge-output from the first high-voltage power supply part 110Y to the first charger 117Y. Hereby, the applying timing in which the first high-voltage power supply part 110Y applies the high voltage to the first charger 117Y is shifted from the applying timing in which the second to fourth high-voltage power supply parts 110M, 110C and 110K apply the high voltage to the second to fourth chargers 117M, 117C and 117K (refer to FIG. 3 and S5 in FIG. 5).

Thereafter, the CPU 91 detects the discharge state of the first charger 117Y. Since this detection of the discharge state is similar to the above-described detection of the discharge state of the fourth charger 117K, its description is omitted (refer to FIG. 3 and S6 in FIG. 5). In case that the discharge detection circuit 130 outputs the discharge detection signal "H" to the CPU 91, the CPU 91 determines that the first charger 117Y is discharged normally, that is, the arc discharge is not produced in the first charger 117Y, and keeps the Y discharge flag "0". Next, the CPU 91 stops the charge-output from the first high-voltage power supply part 110Y to the first charger 117Y, and performs the charge-output from the second high-voltage power supply part 110M to the second charger 117M. Hereby, the applying timing in which the second high-voltage power supply part 110M applies the high voltage to the second charger 117M is shifted from the applying timing in which the first, third, and fourth high-voltage power supply parts 110Y, 110C, 110K apply the high voltage to the first, third and fourth chargers 117Y, 117C and 117K (refer to FIG. 3, and S6: NO and S8 in FIG. 5).

Thereafter, the CPU 91 detects the discharge state of the second charger 117M. Since this detection of the discharge state is similar to the above-described detection of the discharge state of the fourth charger 117K, its description is omitted (refer to FIG. 3 and S9 in FIG. 5). In case that the discharge detection circuit 130 outputs the discharge detection signal "H" to the CPU 91, the CPU 91 determines that the second charger 117M is discharged normally, that is, the arc discharge is not produced in the second charger 117M, and keeps the M discharge flag "0". Next, the CPU 91 stops the charge-output from the second high-voltage power supply part 110M to the second charger 117M, and performs the charge-output from the third high-voltage power supply part 110C to the third charger 117C. Hereby, the applying timing in which the third high-voltage power supply part 110C applies the high voltage to the third charger 117C is shifted from the applying timing in which the first, second and fourth high-voltage power supply parts 110Y, 110M and 110K apply the high voltage to the first, second and fourth chargers 117Y, 117M and 117K (refer to FIG. 3, and S9: NO and S11 in FIG. 5).

Thereafter, the CPU 91 detects the discharge state of the third charger 117C. Since this detection of the discharge state is similar to the above-described detection of the discharge state of the fourth charger 117K, its description is omitted (refer to FIG. 3 and S12 in FIG. 5). In case that the discharge detection circuit 130 outputs the discharge detection signal "H" to the CPU 91, the CPU 91 determines that the third charger 117C is discharged normally, that is, the arc discharge is not produced in the third charger 117C, and keeps the C discharge flag "0".

When the CPU 91 completes to thus detect the discharge states of all the chargers 117 provided for the color electrophotographic printer 1, it next determines whether or not all the discharge flags indicate "0". Hereby, the CPU can determine whether or not any of the chargers 117 has generated the abnormal discharge. Namely, in case that all the discharge flags for yellow (Y), magenta (M), cyan (C) and black (K) indicate "0", the CPU 91 can determine that any chargers 117 do not generate the abnormality, that is, that the arc discharge is not produced in any chargers 117.

In this stage, the charge outputs from the first, second and fourth high-voltage power supply parts 110Y, 110M and 110K are stopped, and printing cannot be performed. Therefore, the CPU 91 causes the first, second and fourth high-voltage power supply parts 110Y, 110M and 110K to generate the high voltages, and causes the first, second and fourth high-voltage power supply parts 110Y, 110M and 110K to perform the charge outputs to the first, second and fourth chargers 117Y, 117M and 117K. Hereby, the first to fourth chargers 117Y, 117M, 117C and 117K are put in a state where they can charge the first to fourth photosensitive members 62Y, 62M, 62C and 62K (refer to FIG. 3 and S15 in FIG. 5).

Thereafter, the CPU 91 performs printing processing. Specifically, the CPU 91 transports a recording sheet 3 picked up from the sheet supply tray 12 between the photosensitive member 62 and the transfer roller 61 by the transportation belt 68. Simultaneously, the CPU 91 rotates the photosensitive member 62, and exposes the surface of the photosensitive member 62 to the laser beam from the exposure unit 41 thereby to form en electrostatic latent image. Thereafter, the CPU 91 supplies the toner from the development unit 51 and makes the electrostatic latent image visible. Since the photosensitive member 62 is charged uniformly by the charger 117 at this time, the toner can be stuck to only the printing portion. After the toner adhering to the surface of the photosensitive member 62 has been transferred onto the recording sheet 3 between the photosensitive member 62 and the transfer roller 61, an image is heat-fixed onto the recording sheet 3 between the heat roller 81 and the pressure roller 82, and the recording sheet 3 is discharged to the discharge tray 10. The color electrophotographic printer 1, upon completion of printing for the printing command, completes the discharge detection processing (refer to FIG. 3, and S16 and S17 in FIG. 5).

<In Case that there is Abnormality in Charger>

Next, a case in which there is abnormality in the fourth charger 117K and there is no abnormality in the first to third chargers 117Y, 117M and 117C will be described.

The charger 117, when the toner and the paper powder accumulate around the charging wire, and a weak portion is produced in the toner and paper powder accumulating portions due to distortion, cracks and peeling-off at one time, generates the arc discharge from its weak portion. The charger 117, when it becomes high in voltage due to the accumulations and further generates the arc discharge, becomes momentarily large in voltage at the discharge time. If the color electrophotographic printer 1 continues printing in this case, poor printing is produced.

Specifically, for example, in case that the color electrophotographic printer 1 performs monochromic printing more than color printing, the frequency in use of the fourth charger 117K becomes high. In this case, in the fourth charger 117K, the black (K) toner and paper powders are easy to accumulate around the charging wire constituting the fourth charger 117K. For example, when cracks are produced in the accumulations around the charging wire of the fourth charger 117K, the portion in which the cracks are produced becomes weak, so that the arc discharge is generated from the portion in which the crack are produced when the fourth photosensitive member 62K is charged. Then, the fourth charger 117K charges the surface of the fourth photosensitive member 62K only partially. Therefore, when the exposure unit 41 exposes the surface of the fourth photosensitive member 62K to the light, a suitable electrostatic latent image cannot be formed on the fourth photosensitive member 62K. As a result, on the fourth photosensitive member 62K, the black (K) toner supplied from the development unit 51 adheres also to other portions than the printing portion, and the recording sheet 3 printed in solid black is discharged on the exit tray 10. Such lowering of printing performance causes uselessness of resources such as toner and paper, which is not preferable.

In view of this point, the color photographic printer 1 in this aspect, when receives a printing command from the personal computer and starts printing, causes the fourth high-voltage power supply part 110K to perform charge-output, thereby to detect the abnormality of the charger 117 on the basis of the detection of the discharge state.

Specifically, when the fourth charger 117K generates, from the portion where cracks are produced in the accumulations around the charging wire, the arc discharge which generates a partially large voltage, the fourth GRID part 118K supplies the large current to the connection point P2K. Though the voltage of the connection point P2 is adjusted by the variable resistor 121K and the varistor 122K, in case that the large current is supplied to the connection point P2K, the variable resistor 121K and the varistor 122K cannot make the voltage of the connection point P2 constant, so that the sharp change in voltage is produced, and the electric current supplied to the connection point P2K is supplied from the condenser 123K through the connection point P1 to the discharge detection circuit 130.

The discharge detection circuit 130 removes noise from the electric current supplied through the resistor 131 and the condenser 132 to the connection point P1, and supplies its electric current to the base of the transistor 133. Then, the base current of the transistor 133 flows, and the transistor 133 is put in the conductive state where the electric current flows between the collector and the emitter. Then, the voltage flowing in the resistor 134 becomes small, and the voltage at the connection point P3 becomes small (becomes 0V or comes close to 0V). Therefore, the discharge detection signal "L" is outputted from the connection point P3 to the input port 91*a* of the CPU 91. The CPU 91, when the input port 91*a* inputs the discharge detection signal "L", determines that the abnormal discharge, that is, the arc discharge is produced in the fourth charger 117K, and raises the K discharge flag "1" (refer to FIG. 3, and S1, S2, S3: YES, and S4 in FIG. 5).

Thereafter, the CPU 91 detects the discharge states of the first to third chargers 117Y, 117M and 117C to detect the abnormality in the discharge states of the first to third chargers 117Y, 117M and 117C. Here, since the first to third chargers 117Y, 117M and 117C do not generate the abnormal discharge, each discharge flag for yellow (Y), magenta (M) and cyan (C) does not indicate "1" but remains "0" (refer to FIG. 3, and S5, S6: NO, S8, S9: NO, S11, and S12: NO in FIG. 5). Since these processing are similar to those in case that there is no abnormality in the discharge state of the charger, these description is omitted.

Sequentially, the CPU 91 determines whether or not all the discharge flags indicate "0", thereby to determine whether or not there is no abnormality in all the first to fourth chargers 117Y, 117M, 117C and 117K, and the CPU 91 determines whether or not all the discharge flags indicate "1", thereby to determine whether or not there is abnormality in all the first to fourth chargers 117Y, 117M, 117C and 117K. Here, since only the K discharge flag indicates "1", the CPU 91 determines that all the discharge flags do not indicate "0" and all the discharge flags do not indicate "1", and determines that abnormality is produced in the discharge state of any discharger 117 (refer to S14: NO and S18: NO in FIG. 5).

Next, the CPU 91 narrows down the charger 117 in which the discharge flag indicates "1" to specify the charger 117 in which the abnormality is produced. Specifically, the CPU 91 determines whether or not the K discharge flag indicates "1". Here, since the K discharge flag indicates "1", abnormal discharge error processing is performed on the fourth charger 117K for black (K) (refer to S20: YES and S21 in FIG. 5).

As the abnormal discharge error processing, for example, an alarm unit such as a liquid crystal display part, a display light, an alarm buzzer, or alarm announce informs a user that the abnormality is produced in the fourth charger 117K, and makes the user clean the fourth charger 117K.

Next, the CPU 91 determines whether or not each discharge flag for yellow (Y), magenta (M) and cyan (C) indicates "1", and determines whether or not the abnormality is produced in the first to third chargers 117Y, 117M and 117C. Here, since each discharge flag for yellow (Y), magenta (M) and cyan (C) does not indicate "1", the abnormal discharge error processing is not performed on the first to third chargers 117Y, 117M and 117C for yellow (Y), magenta (M) and cyan (C) (refer to S22: NO, S24: NO, and S26: NO in FIG. 5).

The CPU 91, after thus informing of the user the abnormality of the fourth charger 117K, completes the abnormal discharge error processing without performing the printing processing. Hereby, before the solid printing is not performed on the recording sheet 3, the abnormality of the charger 117 is detected and printing is stopped, whereby it is possible to prevent the recording sheet 3 and the toner from being used uselessly.

Further, in case that all the first to fourth chargers 117Y, 117M, 117C and 117K generate the abnormal discharge, all the discharge flags for yellow (Y), magenta (M), cyan (C) and black (K) indicate "1". Therefore, the abnormal discharge error processing is immediately executed on the first to fourth chargers 117Y, 117M, 117C and 117K (refer to S1, S2, S3: YES, S4, S5, S6: YES, S7, S8, S9: YES, S10, S11, S12: YES, S13, S14: NO, S18: YES, and S19 in FIG. 5).

<Advantage of Color Electrophotographic Printer>

According to the color electrophotographic printer 1 in this aspect, the four chargers 117Y, 117M, 117C and 117K are connected to the single discharge detection circuit 130 in parallel; when the chargers 117Y, 117M, 117C and 117K charge the photosensitive members 62Y, 62M, 62C, and 62K, in case that any of the chargers becomes momentarily higher in discharge voltage and performs the discharge different from the normal discharge, the discharge detection circuit 130 detects its charge and detects that the abnormality is produced in the charger 117Y, 117M, 117C, or 117K (refer to FIG. 3 and FIG. 5). Therefore, compared with the case where the discharge detection circuits are provided respectively for the chargers 117Y, 117M, 117C and 117K, the number of the discharge detection circuits 130 can be reduced and the circuit structure can be simplified, so that the circuit can be made low in price.

Further, in the color electrophotographic printer 1 in this aspect, the first to fourth high-voltage power supply parts 110Y, 110M, 110C and 110K are connected individually to the first to fourth chargers 117Y, 117M, 117C and 117K, and the CPU 91 controls the high-voltage power supply parts 110Y, 110M, 110C and 110K so as to make different each applying timing in which each high-voltage power supply part 110Y, 110M, 110C, 110K applies the high voltage to the corresponding charger 117Y, 117M, 117C, 117K (refer to S2, S5, S8 and S11 in FIG. 5). Therefore, even in case that the first to fourth chargers 117Y, 117M, 117C and 117K use the discharge detection circuit 130 in common, the discharge detection of the first to fourth chargers 117Y, 117M, 117C and 117K can be performed with the applying timings shifted, whereby it is possible to raise respectively the "1" discharge flags for yellow (Y), magenta (M), cyan (C), and black (K) correspondingly to the switching timing "L"/"H" of the input port 91*a* in the CPU 91 (refer to S14, S18, and S20 to S27 in FIG. 5). Therefore, according to the color electrophotographic printer 1 in this aspect, the CPU 91 narrows down the charger 117 in which the discharge flag indicates "1", whereby it can specify the charger 117 in which the abnormality and specifically the arc discharge is produced.

Further, according to the color electrophotographic printer 1 in this aspect, in the print starting time, the applying timing in which each high-voltage power supply part 110Y, 110M, 110C, 110K applies the high-voltage to the corresponding charging part 117Y, 117M, 117C, 117K is made different (refer to S2, S5, S8 and S11 in FIG. 5). Therefore, the abnormal discharge of the charger 117 can be detected before printing.

(Second Aspect)

An image forming apparatus according to a second aspect is applied to a color electrophotographic printer 1 similarly to that in the first aspect. The color electrophotographic printer 1 in the second aspect is different from the color electrophotographic printer 1 in the first aspect in that there are provided a first discharge detection circuit 1130 which detects discharge of first to third chargers 117Y, 117M and 117C, and a second discharge detection circuit 2130 which detects discharge of a fourth charger 117K. Therefore, here, the different point between the first aspect and the second aspect will be described and the description of the common point will be appropriately omitted. Further, regarding the configuration similar to that in the first aspect, the same reference numerals are used in its description and drawings.

<Discharge Detection Circuit>

Figure 6:
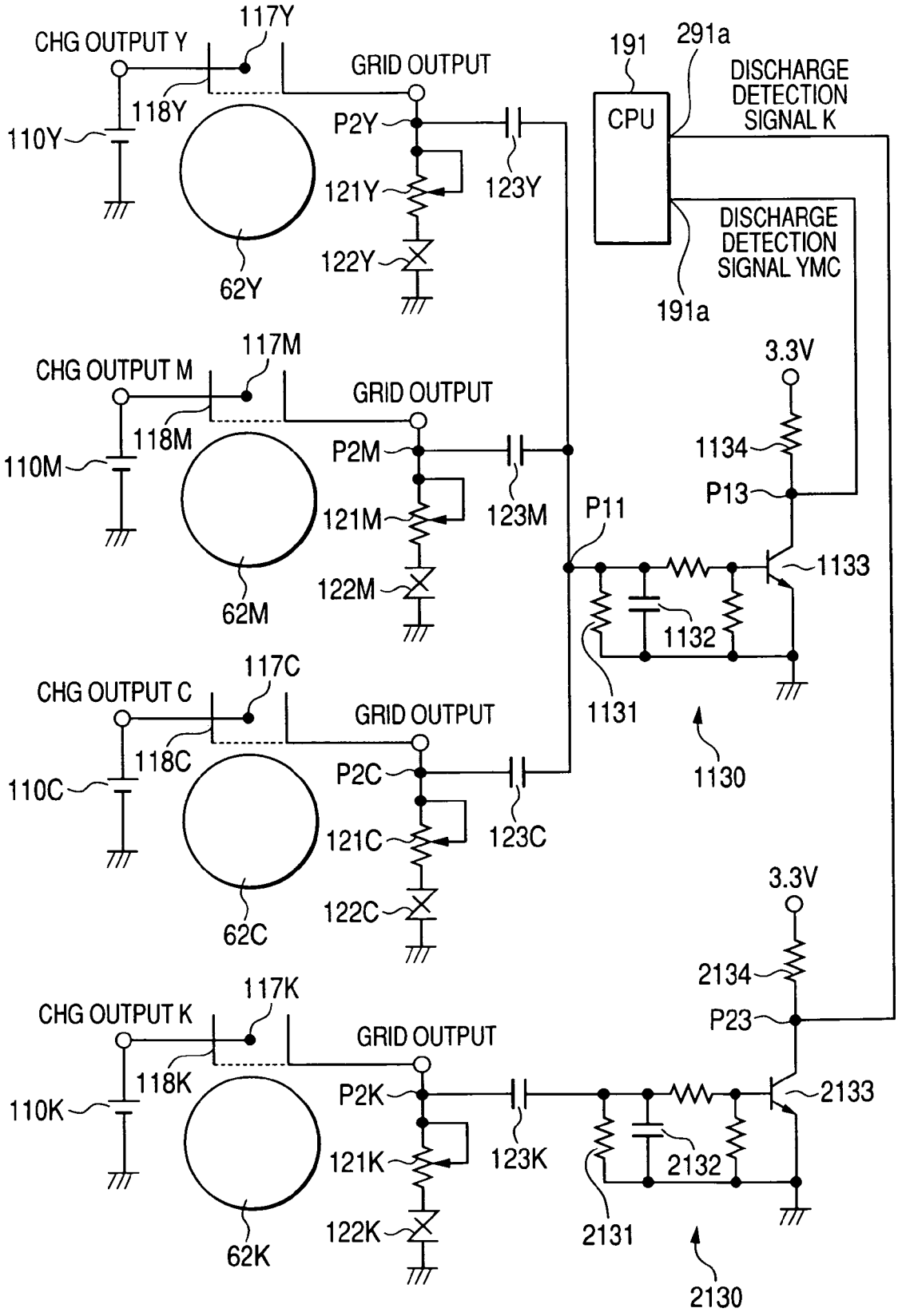
FIG. 6 is a diagram showing a discharge detection circuit used in a color electrophotographic printer according to a second aspect.

FIG. 6 is a diagram showing discharge detection circuits 1130 and 2130 used by the color electrophotographic printer 1 in the second aspect.

In this aspect, the first discharge detection circuit 1130 and the second discharge detection circuit 2130 are connected to a CPU 191.

To the first discharge detection circuit 1130, the first charger 117Y, the second charger 117M, and the third charger 117C are connected in parallel, and use the first discharge detection circuit 1130 in common. The first discharge detection circuit 1130 is composed of a resistor 1131, a condenser 1132, a transistor 1133 and a resistor 1134, and has the similar function to that of the discharge detection circuit 130 in the first aspect.

Further, to the second discharge detection circuit 2130, only the fourth charger 117K is connected, and the second discharge detection circuit 2130 performs abnormal detection of the fourth charger 117K specially. The second discharge detection circuit 2130 includes a resistor 2131, a condenser 2132, a transistor 2133 and a resistor 2134, and has the similar function to that of the discharge detection circuit 130 in the first aspect.

For the CPU 191, there are provided a first input port 191*a* connected through a connection point P13 to the first discharge detection circuit 1130, and a second input port 291*a* connected through a connection point P23 to the second discharge detection circuit 2130. The first input port 191*a* and the second input port 291*a* detect the voltages of the connection points P13 and P23 thereby to detect abnormality in the first to fourth charger 117Y, 117M, 117C and 117K. The CPU 191 executes a discharge detection program for detecting the discharges of the first to fourth charger 117Y, 117M, 117C and 117K.

<Discharge Detection Program>

Figure 7:
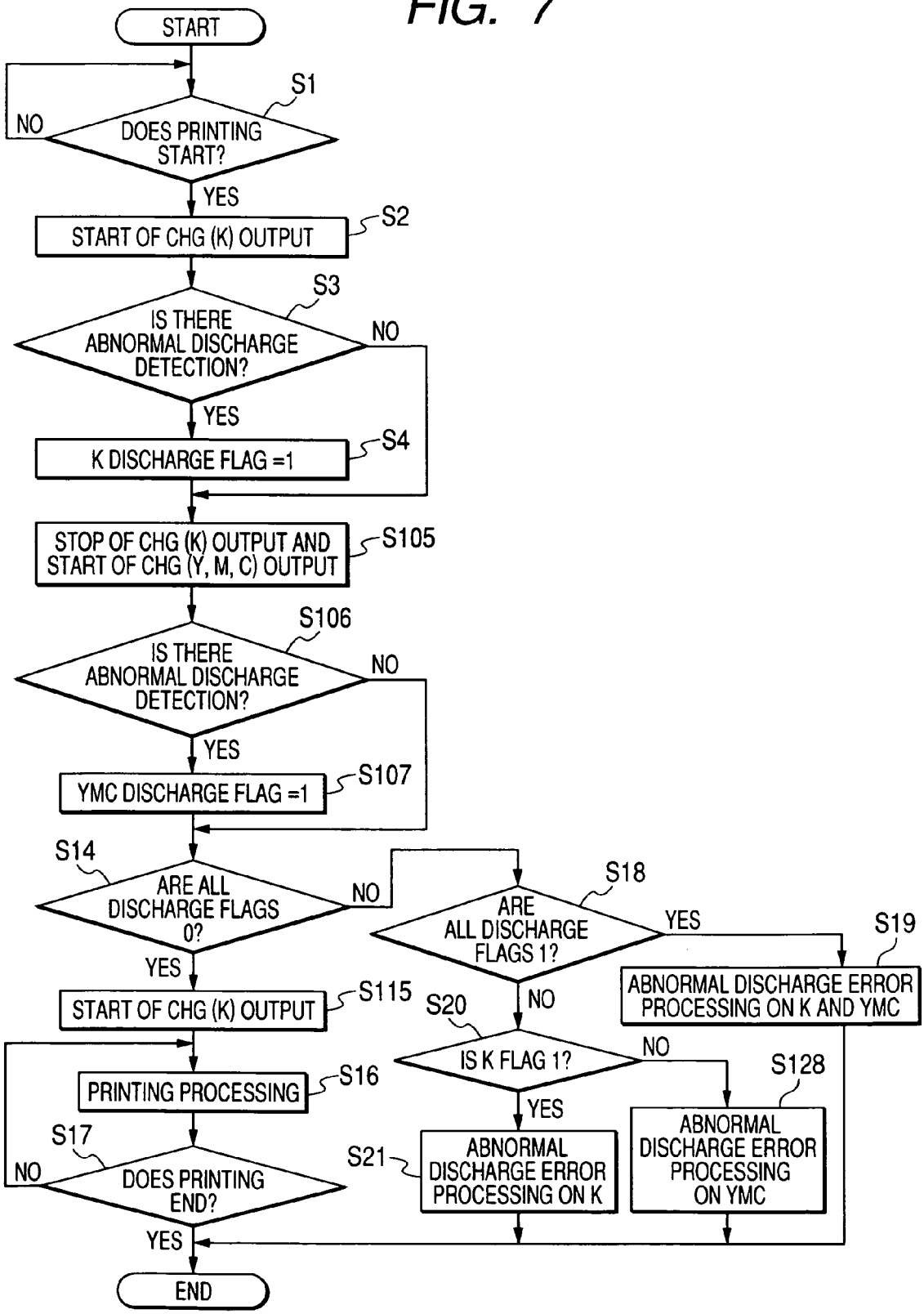
FIG. 7 is a diagram showing a processing procedure of a discharge detection program executed by CPU shown in FIG. 6.

FIG. 7 is a diagram showing a processing procedure of the discharge detection program executed by the CPU 191 shown in FIG. 6.

The discharge detection program shown in FIG. 7 is saved in a ROM 92 of a control part 90 (refer to FIG. 2). The discharge detection program shown in FIG. 7 is different, in that the abnormal discharge detection of the fourth charger 117K for black (K) is performed separately from the abnormal discharge detections of the first charger 117Y for yellow (Y), the second charger 117M for magenta (M) and the third charger 117C for cyan (C), from the discharge detection program (refer to FIG. 5) in the first aspect in which the abnormal discharge detections of the first to fourth chargers 117Y, 117M, 117C and 117K are performed individually.

The discharge detection program shown in FIG. 7 detects a discharge state of the fourth charger 117K in S1 to S4, and thereafter stops, in S105, outputting a charge voltage from a fourth high-voltage power supply part 110K to the fourth charger 117K, and simultaneously outputs charge voltages from first to third high-voltage power supply parts 110Y, 110M and 110C to the first to third chargers 117Y, 117M and 117C.

In S106, the program determines whether or not the first discharge detection circuit 1130 has detected abnormal discharge. In case that the program determines that the first discharge detection circuit 1130 has not detected the abnormal discharge, the program proceeds to S14. On the other, in case that all the first to third chargers 117Y, 117M and 117C or any of them has generated the abnormal discharge, and the first discharge detection circuit 1130 has detected the abnormal discharge, the program raises, in S107, a YMC discharge flag, which controls discharge of yellow (Y), magenta (M) and cyan (C) together, of "1", and thereafter proceeds to S14.

In case that both the K discharge flag and the YMC discharge flag indicate "0" (S14: YES), the program outputs the charge voltage from the fourth high-voltage power supply part 110K in S115, and thereafter performs printing processing in S16. When printing is completed (S17: YES), the program ends the discharge detection processing for the printing command.

To the contrary, in case that both the K discharge flag and the YMC discharge flag do not indicate "0", in case that both the K discharge flag and the YMC discharge flag do not indicate "1", and in case that the K discharge flag does not indicate "1" (S14: NO, S18: NO, S20: NO), the program performs abnormal discharge error processing on the first to third chargers 117Y, 117M and 117C in S128, and thereafter ends the discharge detection processing for the printing command.

<Operation of Color Electrophotographic Printer>

Here, taking a case where the first charger 117Y generates the abnormal discharge as an example, the operations of the color electrophotographic printer will be described.

Since the fourth charger 117 in the color electrophotographic printer 1 is not generating the abnormal discharge, the program, while keeping the K discharge flag "0", performs the abnormal discharge detection for the first to third chargers 117Y, 117M and 117C (refer to S1, S2, and S3: NO in FIG. 7).

Specifically, the program stops the output of the charge voltage from the fourth high-voltage power supply part 110K to the fourth charger 117K, and performs the output of the charge voltage from the first to third high-voltage power supply parts 110Y, 110M and 110C to the first to third chargers 117Y, 117M and 117C. Hereby, applying timing in which the first to third high-voltage power supply parts 110Y, 110M and 110C apply the high voltage to the first to third chargers 117Y, 117M and 117C is different from applying timing in which the fourth high-voltage power supply part 110K applies the high voltage to the fourth charger 117K.

In this case, since the second and third chargers 117M and 117C which is not generating the abnormal discharge charge the second and third photosensitive members 62M and 62C by corona discharge, the electric current supplied from second and third GRID parts 118M and 118C do not flow in condensers 123M and 123C. However, in case that the first charger 117Y generates the abnormal discharge such as arc discharge, the electric current supplied from a first GRID part 118Y flows in a condenser 123Y and is supplied to the first discharge detection circuit 1130. In the first discharge detection circuit 1130, base current flows in a transistor 1133, and the transistor 1133 is put in the conductive state. Then, the CPU 191, by switching of the first input port 191*a* from "H" to "L", detects the abnormal discharge, and raises the YMC discharge flag "1" (refer to S105, S106: YES, and S107 in FIG. 7).

In this case, since all the discharge flags do not indicate "0", all the discharge flags do not indicate "1", and the K discharge flag does not indicate "1", the abnormal discharge error processing is executed on the first to third chargers 117Y, 117M and 117C.

Here, it is generally thought in the color electrophotographic printer 1 that frequencies in use of yellow (Y), magenta (M) and cyan (C) are nearly the same, and toner and paper powder adhere to charging wires constituting the first to third chargers 117Y, 117M and 117C at the same degree and accumulate thereon. Therefore, in this aspect, the abnormal discharge error processing is executed not only on the first charger 117Y which has generated the abnormal discharge, but also on the second and third chargers 117M and 117C. Hereby, it is possible to reduce such labor that due to the abnormality produced in the second charger 117M immediately after a user has cleaned only the first charger 117Y in which the abnormality has been detected, the user cleans the second charger 117M.

<Advantage of Color Electrophotographic Printer>

According to the color electrophotographic printer 1 in this aspect, for the fourth charger 117K arranged correspondingly to the fourth photosensitive member 62K bearing the black (K) toner, the dedicated second discharge detection circuit 2130 is provided; for the first charger 117Y arranged correspondingly to the first photosensitive member 62Y bearing the yellow (Y) toner, for the second charger 117M arranged correspondingly to the second photosensitive member 62M bearing the magenta (M) toner, and for the third charger 117C arranged correspondingly to the third photosensitive member 62C bearing the cyan (C) toner, the single first discharge detection circuit 1130 is provided in common. Hereby, the circuit configuration can be simplified and can be made low in price. Further, in case that the frequency in use of black (K) is higher than each frequency in use of yellow (Y), magenta (M) and cyan (C), it is possible to reduce frequency in use of the first discharge detection circuit 1130 and make long the life of the first discharge detection circuit 1130.

Further, in the color electrophotographic printer 1 in the invention, the CPU 191 makes applying timing in which the first high-voltage power supply part 110Y, the second high-voltage power supply part 110M and the third high-voltage power supply part 110C apply the high-voltage to the first charger 117Y, the second charger 117M, and the third charger 117C different from the applying timing in which the fourth high-voltage power supply part 110K applies the high voltage to the fourth charger 117K. Therefore, on the basis of the applying timing, it is possible to specify any of the first to third chargers 117Y, 117M and 117C, and the fourth charger 117K as the charger which is generating the abnormal discharge, and specifically the arc discharge.

Further, according to the color electrophotographic printer 1, in the print starting time, the applying timing in which the first high-voltage power supply part 110Y, the second high-voltage power supply 110M, and the third high-voltage power supply 110C apply the high voltage to the first charger 117Y, the second charger 117M, and the third charger 117C is made different from the applying timing in which the fourth high-voltage power supply part 110K applies the high voltage to the chargers 117K. Therefore, the abnormal discharge of the charger 117 can be detected before the print processing, and it is possible to prevent the recording sheets 3 and the toner from being used uselessly.

Although the aspects of the invention have been described, the invention is not limited to the above aspects, but can be applied variously.

(1) For example, although the image forming apparatus is applied to the color electrophotographic printer 1 in the above aspects, it may be applied to a multifunctional machine, a facsimile device, a copying machine, or the like.

(2) For example, although the abnormal discharge of the charger 117 is detected when the discharge flag is raised at one time in the aspects, the abnormal discharge of the charger 117 may be detected when the discharge flag is raised at plural times. In this case, when the discharge flag is raised at plural times, the abnormal discharge error processing may be performed; or when the discharge flag is first raised, only the error display may be performed, and when the discharge flag is raised at plural times, the image formation by the image forming apparatus may be stopped.

(3) For example, although the abnormal discharge detections of the plural chargers 117 are performed individually in the first aspect, the abnormal discharge detections of the chargers 117 may be performed by color groups such as black (K), and yellow-magenta-cyan (YMC). Further, although the abnormal discharge detections of the first to third chargers 117Y, 117M and 117C are performed in a batch in the above second aspect, the abnormal discharge detections of them may be performed individually to specify the charger 117 in which the abnormal discharge is produced.

(4) Although the case where the color electrophotographic printer 1 has the four chargers 117Y, 117M, 117C and 117K for yellow (Y), magenta (M), cyan (C) and black (K) has been described in the above aspects, the number of the chargers 117 is not limited to this but may be more than four or less than four. Further, color combination of yellow (Y), magenta (M), cyan (C) and black (K) may be changed.

(5) Although the abnormal discharge detection is performed on the charger 117 in the above aspects, the detection of the discharge state may be performed also on the static eliminator 33 by means of the discharge detection circuit and the discharge detection program which are similar to those used in the detection on the charger 117.

What is claimed is:

1. An image forming apparatus comprising:

a plurality of photosensitive members;

a plurality of charging units respectively opposed to the plurality of photosensitive members;

a high-voltage power supply unit which applies a voltage to the charging unit; and a discharge detecting unit which detects discharge of the plurality of the charging units and detects abnormality of the plurality of the charging units, wherein the plurality of charging units are connected to the discharge detecting unit in parallel.

2. The image forming apparatus according to claim 1, wherein the high-voltage power supply unit comprises a plurality of high-voltage power supply units respectively provided for the plurality of charging units.

3. The image forming apparatus according to claim 2, further comprising a high-voltage power supply control unit which controls the plurality of high-voltage power supply units so as to apply the voltage to the corresponding charging units at different timings.

4. The image forming apparatus according to claim 3, wherein the high-voltage power supply control unit varies the applying timings of the voltage to the corresponding charging units at an image formation starting time.

5. An image forming apparatus comprising:

a plurality of photosensitive members;

a plurality of static eliminating units respectively opposed to the plurality of photosensitive members;

a high-voltage power supply unit which applies a voltage to the static eliminating unit; and a discharge detecting unit which detects discharge of the plurality of the static eliminating units and detects abnormality of the plurality of the static eliminating units, wherein the plurality of static eliminating units are connected to the discharge detecting unit in parallel.

6. The image forming apparatus according to claim 5, wherein the high-voltage power supply unit comprises a plurality of high-voltage power supply units respectively provided for the plurality of static eliminating units.

7. The image forming apparatus according to claim 6, further comprising a high-voltage power supply control unit which controls the plurality of high-voltage power supply units so as to apply the voltage to the corresponding static eliminating units at different timings.

8. The image forming apparatus according to claim 7, wherein the high-voltage power supply control unit varies the applying timings of the voltage to the corresponding static eliminating units at an image formation starting time.

9. An image forming apparatus comprising:

a plurality of photosensitive members including a first photosensitive member which bears yellow developer, a second photosensitive member which bears magenta developer, a third photosensitive member which bears cyan developer, and a fourth photosensitive member which bears black developer;

a plurality of charging units including a first charging unit arranged correspondingly to the first photosensitive member, a second charging unit arranged correspondingly to the second photosensitive member, a third charging unit arranged correspondingly to the third photosensitive member, and a fourth charging unit arranged correspondingly to the fourth photosensitive member;

a high-voltage power supply unit which applies a voltage to the charging unit; and a discharge detecting unit which detects discharge of the charging unit when the high-voltage power supply unit applies the voltage to the charging unit thereby to detect abnormality of the charging unit, the discharge detecting unit including a common discharge detecting unit, to which the first, second and third charging units are connected in parallel, and a black discharge detecting unit connected to the fourth charging unit.

10. The image forming apparatus according to claim 9, wherein the high-voltage power supply unit includes a first high-voltage power supply unit provided for the first charging unit, a second high-voltage power supply unit provided for the second charging unit, a third high-voltage power supply unit provided for the third charging unit, and a fourth high-voltage power supply unit provided for the fourth charging unit.

11. The image forming apparatus according to claim 10, further comprising a high-voltage power supply control unit which controls the first, second, third and fourth high-voltage power supply units so as to apply the voltage to the first, second, third and fourth charging units at different timings.

12. The image forming apparatus according to claim 11, wherein the high-voltage power supply control unit varies the applying timings of the voltage to the corresponding charging units at an image formation starting time.

13. An image forming apparatus comprising:

a plurality of photosensitive members including a first photosensitive member which bears yellow developer, a second photosensitive member which bears magenta developer, a third photosensitive member which bears cyan developer, and a fourth photosensitive member which bears black developer;

a plurality of static eliminating units including a first static eliminating unit arranged correspondingly to the first photosensitive member, a second static eliminating unit arranged correspondingly to the second photosensitive member, a third static eliminating unit arranged correspondingly to the third photosensitive member, and a fourth static eliminating unit arranged correspondingly to the fourth photosensitive member;

a high-voltage power supply unit which applies a voltage to the static eliminating unit; and a discharge detecting unit which detects discharge of the static eliminating unit when the high-voltage power supply unit applies the voltage to the static eliminating unit thereby to detect abnormality of the static eliminating unit, the discharge detecting unit including a common discharge detecting unit, to which the first, second and third static eliminating units are connected in parallel, and a black discharge detecting unit connected to the fourth static eliminating unit.

14. The image forming apparatus according to claim 13, wherein the high-voltage power supply unit includes a first high-voltage power supply unit provided for the first static eliminating unit, a second high-voltage power supply unit provided for the second static eliminating unit, a third high-voltage power supply unit provided for the third static eliminating unit, and a fourth high-voltage power supply unit provided for the fourth static eliminating unit.

15. The image forming apparatus according to claim 14, further comprising a high-voltage power supply control unit which controls the first, second, third and fourth high-voltage power supply units so as to apply the voltage to the first, second, third and fourth static eliminating units at different timings.

16. The image forming apparatus according to claim 15, wherein the high-voltage power supply control unit varies the applying timings of the voltage to the corresponding static eliminating units at an image formation starting time.

* * * * *